US005477588A

United States Patent [19]

Iida et al.

[11] Patent Number: 5,477,588

[45] Date of Patent: Dec. 26, 1995

[54] POWER BLOWER

[75] Inventors: Giichi Iida, Tokyo; Kazunori Takahashi, Fuchu, both of Japan

[73] Assignee: Kioritz Corporation, Tokyo, Japan

[21] Appl. No.: 149,140

[22] Filed: Nov. 1, 1993

Related U.S. Application Data

[63] Continuation of Ser. No. 926,422, Aug. 7, 1992, abandoned.

[30] Foreign Application Priority Data

Sep. 26, 1991 [JP] Japan ..... 3-077951 U

[51] Int. Cl.[6] ..... A47L 5/00

[52] U.S. Cl. ..... 15/405; 15/412; 15/327.2

[58] Field of Search ..... 15/405, 330, 406, 15/327.2, 412

[56] References Cited

U.S. PATENT DOCUMENTS

| | | | |
|---|---|---|---|
| Re. 33,050 | 9/1989 | Tuggle et al. | 15/405 |
| 3,863,291 | 2/1975 | Woelffer | 15/405 |
| 4,223,419 | 9/1980 | Sato et al. . | |
| 4,269,571 | 5/1981 | Shikutani et al. | 15/405 |
| 4,318,203 | 3/1982 | Satoh et al. . | |
| 4,451,951 | 6/1984 | Satoh . | |
| 4,517,939 | 5/1985 | Kiyooka et al. . | |
| 4,644,606 | 2/1987 | Luerken et al. . | |
| 4,734,017 | 3/1988 | Levin | 15/405 |
| 4,800,616 | 1/1989 | Wade | 15/405 |
| 4,945,604 | 8/1990 | Miner et al. | 15/405 |
| 5,035,586 | 7/1991 | Sadler et al. | 15/405 |
| 5,052,073 | 10/1991 | Iida . | |

FOREIGN PATENT DOCUMENTS 58-49791 11/1983 Japan .

*Primary Examiner*—David Scherbel
*Assistant Examiner*—James F. Hook
*Attorney, Agent, or Firm*—Browdy and Neimark

[57] ABSTRACT

A power blower includes a fan case arranged fore and aft in the axial direction of a fan; and an engine, wherein a central opening having an inner diameter larger than the outer diameter of the fan is formed on a front member of the fan case, and a lid member is releasably mounted on the central opening.

6 Claims, 1 Drawing Sheet

POWER BLOWER

This application is a continuation of application Ser. No. 07/926,422, filed Aug. 7, 1992, now abandoned.

BACKGROUND OF THE INVENTION

1. Field of the Invention

The present invention relates to a blower.

2. Description of the Related Art

Hitherto, a main body of a power blower has been formed of a fan case which has a fan mounted on an end of the output shaft of said engine and which encloses the fan, and of the engine, said power blower being used for wind blowers, powered mist spray machines or the like in whirl air-cooled two-cycle gasoline engines or the like are installed as power sources. For this reason, when an engine is dismounted from a machine's main body for maintenance and inspection, first a great number of screws are unscrewed, a fan case is disassembled and removed from the machine's main body, the fan is dismounted from the output shaft of the engine, and thereafter the engine must be dismounted from the blower's main body. As a consequence, there are drawbacks in that, the operation is laborious, and when tapping screws are used for assembling the fan cases, the screws do not work during the disassembly and assembly.

SUMMARY OF THE INVENTION

Accordingly, an object of the present invention is to provide a power blower which solves the above-mentioned problems of the prior art and is simple in construction and convenient to use.

To this end, according to the present invention, there is provided a power blower which comprises a fan case arranged fore and aft in the axial direction of a fan; and an engine, wherein a central opening having an inner diameter larger than the outer diameter of the fan is formed on a front member of the fan case, and a lid member is releasably mounted on the central opening.

Accordingly, the fan can be dismounted from the fan case through the central opening on the front side thereof by merrily dismounting the lid member from the fan case, the engine can be easily dismounted from the blower's main body, an operation for maintaining and checking power blowers can be easily performed, and low-cost means, such as tapping screws, can be used for assembling fan cases.

The aforementioned and other objects, features and advantages of the present invention will become clear when reference is made to the following description of the preferred embodiment of the present invention, together with reference to the accompanying drawing.

DESCRIPTION OF THE PREFERRED EMBODIMENT

Figure 1:
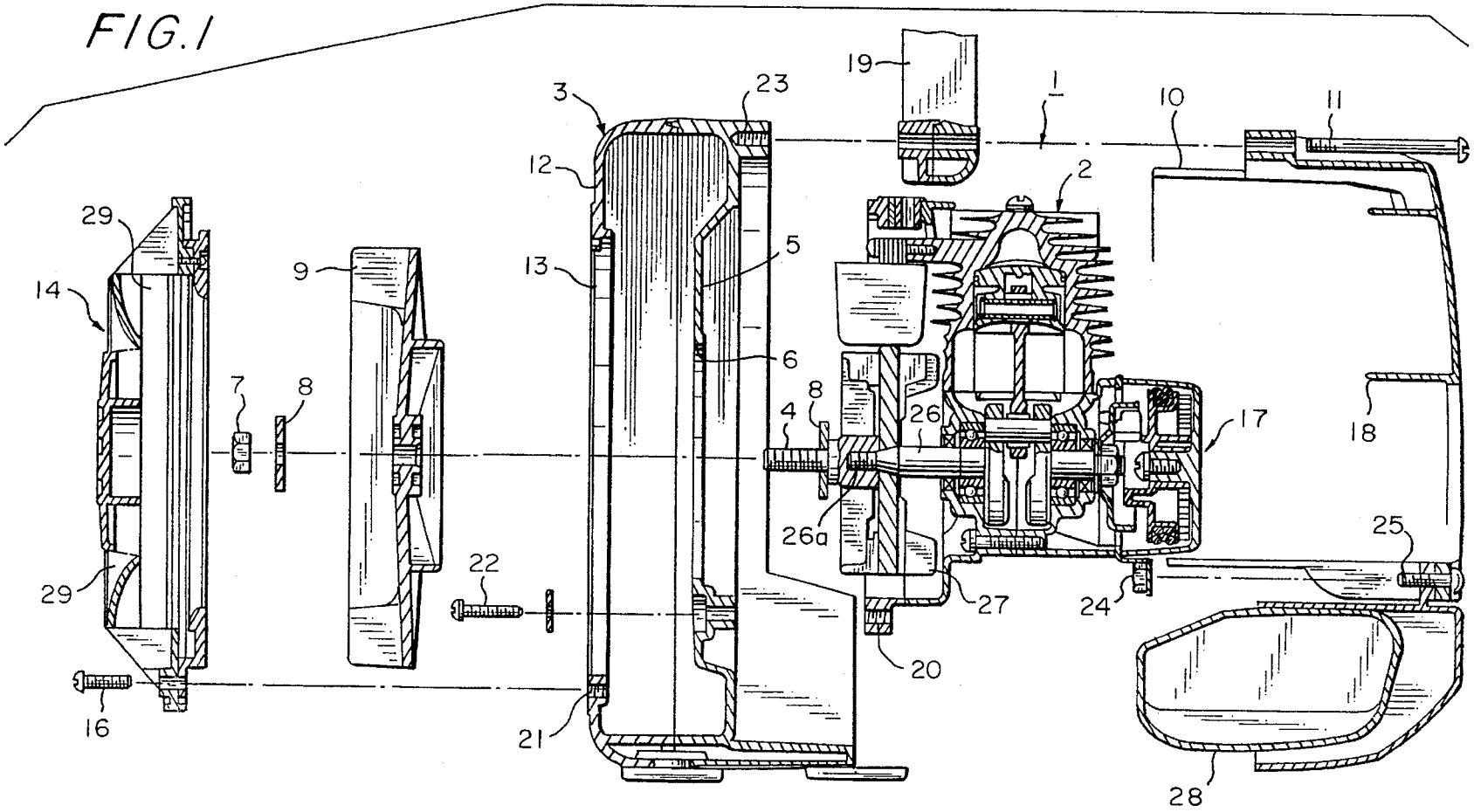
FIG. 1 is a sectional view in which an essential portion of an embodiment of a power blower of the present invention is exploded.

An embodiment of the present invention will be explained below with reference to the accompanying drawing.

FIG. 1 is a sectional view in which an essential portion of an embodiment of a power blower used as a hand-held power blower of the present invention is exploded. In this power blower 1, an air-cooled two-cycle gasoline engine 2 is mounted on a fan case 3 by using bolts 22. The fan case 3 placed on the front side in the axial direction of an output shaft 26 of the engine 2 is formed in such a way that a front member 12 and a rear member 5 are combined and fixedly secured to each other by a proper number of tapping screws (not shown). An extension shaft 4 fixedly secured to a threaded output shaft end **26*a* of the engine 2 extends into the fan case 3 through a central hole 6 formed in the rear member 5 of the fan case 3. An air blowing fan 9 is releasably mounted thereon by means of a nut 7 screwed to the extension shaft 4 and washes 8. The fan 9 is rotatably driven by the engine 2 inside the fan case 3. The periphery of the engine 2 is covered from behind with an engine cover 10 having an insertion opening 18 for a recoil starter 17 and accommodating a fuel tank 28. The upper section of the engine cover 10 is fixed to the fan case 3 by bolts 11 (one of them is shown in the figure) screwed to the fan case 3 through a carrying handle 19. The lower section of the engine cover 10 is fixed by bolts 25 to screw hole portions 24 of the engine 2. A circular air-intake central opening 13 is formed in the front member 12 of the fan case 3. The central opening 13 has an inner diameter larger than the outer diameter of the air blowing fan 9. A protective lid member 14 having air-intake openings 29 is turnably fitted to the central opening 13, and is releasably mounted on the fan case 3 by proper locking means such as a bolt 16 and a tapped hole 21 as the example shown). The engine 2 is fixedly secured to the fan case 3 by screwing a proper number of bolts 22 to tapped mounting holes 20 from the side of the central opening 13. Therefore, the engine 2 is properly held inside of a case formed by the fan case 3 and the engine cover 10. In the drawing, reference numeral 27 denotes a magnet rotor which serves also as an engine cooling fan. If the diameter of the central hole 6 of the rear member 5 of the fan case 3 is made larger than the diameter of the magnet rotor 27**, it is preferable during disassembly.

When the engine 2 is maintained or checked, the bolt 16 is removed from the fan case 3 and the fitting engagement is released by turning the lid member 14 and it is removed from the fan case 3. By releasing the nut 7 and the washer 8 from the extension shaft 4 of the engine 2, the fan 9 can be taken out to the front outside through the central opening 13 of the front member 12 from the inside of the fan case 3. Furthermore, if necessary, the engine cover 10 can be taken off from the engine 2, and then the bolts 22 mounted on the fan case 3 are released. Thus, the engine 2 can be maintained or checked easily. After the maintenance or check operation, the operation for mounting the engine 2 can be performed easily by reversing the above-described steps. In all of these operations, an operation for disassembling the fan case 3 need not be performed, and therefore an operation for removing tapping screws, by which the fan case 3 is assembled, need not be performed.

Many different embodiments of the present invention may be constructed without departing from the spirit and scope of the present invention. It should be understood that the present invention is not limited to the specific embodiment described in this specification. To the contrary, the present invention is intended to cover various modifications and equivalent arrangements included with the spirits and scope of the claim. The following claim is to be accorded a broad interpretation, so as to encompass all such modifications and equivalent structures and functions.

What is claimed is:

1. A power blower, comprising:

a blower fan;

a blower fan case arranged fore and aft in the axial direction of said fan; and an engine drivingly engaged to said blower fan, wherein a central opening having an inner diameter larger than the outer diameter of said blower fan is formed at a central position of said blower fan case on the fore side thereof to make said blower fan insertable or removable therethrough, and a protective lid member having at least one air-intake opening is releasably mounted on and to close said central opening.

2. A power blower, comprising:

a blower fan;

a blower fan case arranged fore and aft in the axial direction of said blower fan;

said blower fan case having a front wall and a rear wall, an engine driving said blower fan mounted on an opposite side of said rear wall from said fan;

a first central opening having an inner diameter larger than the outer diameter of said fan formed at a central portion of said front wall to make said blower fan insertable or removable therethrough;

a second central opening formed at a central portion of said rear wall; and a protective lid member having at least one air-intake opening releasably mounted on and to close said first central opening.

3. The power blower according to claim 2; wherein said engine has a magnet rotor for cooling said engine; and said second central opening having an inner diameter larger than the outer diameter of said magnet rotor, said magnet rotor, being coaxially mounted between said fan and said engine.

4. A power blower, comprising:

a blower fan;

a blower fan case arranged fore and aft in the axial direction of said blower fan;

said blower fan case having a front wall and a rear wall, an engine driving said blower fan mounted on an opposite side of said rear wall from said fan;

a first central opening having an inner diameter larger than the outer diameter of said fan formed at a central portion of said front wall permitting insertion or removal of said blower fan therethrough without disassembling said blower fan case;

a second central opening formed at a central portion of said rear wall; and a protective lid member having at least one air-intake opening, releasably mounted on, and closing said first central opening.

5. The power blower according to claim 4 wherein:

said protective lid member is turnably mounted in and closes said first central opening.

6. The power blower according to claim 5 wherein:

said blower fan case is fixedly secured in one piece on said power blower in a manner facilitating easier insertion or removal of blower fan through said first central opening.

* * * * *